US009845656B2

(12) United States Patent
Zimmerman et al.

(10) Patent No.: US 9,845,656 B2
(45) Date of Patent: Dec. 19, 2017

(54) EXTENDED LENGTH PACKER WITH TIMED SETTING

(71) Applicant: Weatherford/Lamb, Inc., Houston, TX (US)

(72) Inventors: Patrick J. Zimmerman, Houston, TX (US); Charles D. Parker, Sugar Land, TX (US); Michael C. Derby, Houston, TX (US); Brandon C. Goodman, Kingwood, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 385 days.

(21) Appl. No.: 14/200,566

(22) Filed: Mar. 7, 2014

(65) Prior Publication Data

US 2014/0251640 A1 Sep. 11, 2014

Related U.S. Application Data

(60) Provisional application No. 61/774,727, filed on Mar. 8, 2013, provisional application No. 61/776,561, filed on Mar. 11, 2013.

(51) Int. Cl.
*E21B 33/128* (2006.01)
*E21B 33/12* (2006.01)

(52) U.S. Cl.
CPC ..... *E21B 33/1208* (2013.01); *E21B 33/128* (2013.01)

(58) Field of Classification Search
CPC ..... F16J 15/121; F16J 15/122; F16J 15/123; F16J 15/024; F16J 15/025; F16J 15/027; F16J 15/028; E21B 33/128; E21B 33/1208; E21B 2033/005; E21B 23/06; E21B 33/1285
See application file for complete search history.

(56) References Cited

U.S. PATENT DOCUMENTS

| | | | |
|---|---|---|---|
| 2,196,668 | A | 4/1940 | Ragan |
| 2,390,372 | A | 12/1945 | Johnston |
| 3,587,736 | A | 6/1971 | Brown |
| 5,605,195 | A | 2/1997 | Eslinger et al. |

(Continued)

FOREIGN PATENT DOCUMENTS

| | | | |
|---|---|---|---|
| GB | 2 357 098 | A | 6/2001 |
| WO | 9834008 | A | 8/1998 |

OTHER PUBLICATIONS

International Search Report received for counterpart PCT appl. PCT/US2014/022016, dated Jan. 23, 2015.

(Continued)

*Primary Examiner* — Kipp Wallace
(74) *Attorney, Agent, or Firm* — Blank Rome, LLP

(57) ABSTRACT

A device and method to control the rate of radial expansion of a compressible sealing element on a packer over the longitudinal length of the sealing element. By varying the rate of compression of the element, the rate of radial expansion of the corresponding portions of the element may also be controlled. Additionally, the rate of radial expansion may also be controlled by controlling the direction and amount of radial expansion along the length of the sealing by reinforcing certain portions of the sealing element while decreasing the rigidity of the reinforcement for other portions.

17 Claims, 4 Drawing Sheets

(56) References Cited

U.S. PATENT DOCUMENTS

| | | | | |
|---|---|---|---|---|
| 5,904,354 | A * | 5/1999 | Collins | F16J 15/028 166/187 |
| 6,752,205 | B2 | 6/2004 | Kutac et al. | |
| 7,172,027 | B2 | 2/2007 | Simpson et al. | |
| 7,234,533 | B2 | 6/2007 | Gambier | |
| 7,316,271 | B2 * | 1/2008 | Moyes | B21C 37/16 166/118 |
| 7,591,321 | B2 * | 9/2009 | Whitsitt | E21B 33/1272 166/187 |
| 2008/0223588 | A1 | 9/2008 | Marshall | |
| 2009/0205840 | A1 | 8/2009 | O'Connor et al. | |
| 2009/0205843 | A1 * | 8/2009 | Gandikota | E21B 33/1208 166/387 |
| 2009/0242215 | A1 | 10/2009 | Eatwell | |
| 2011/0247835 | A1 | 10/2011 | Crabb | |
| 2014/0318812 | A1 * | 10/2014 | Moyes | E21B 33/128 166/381 |

OTHER PUBLICATIONS

First Office Action received in counterpart Canadian Appl. 2904445, dated Aug. 9, 2013, 3-pgs.

* cited by examiner

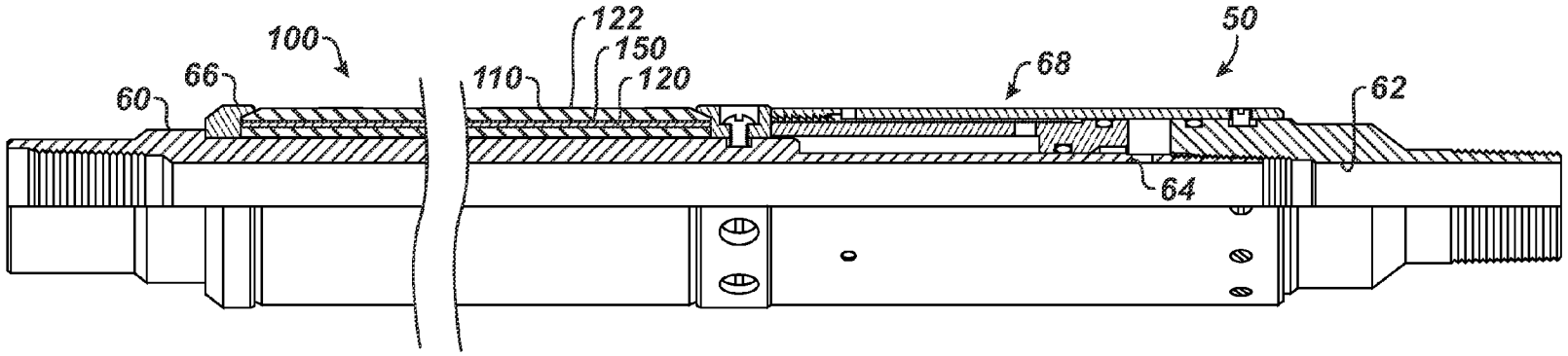
FIG. 2
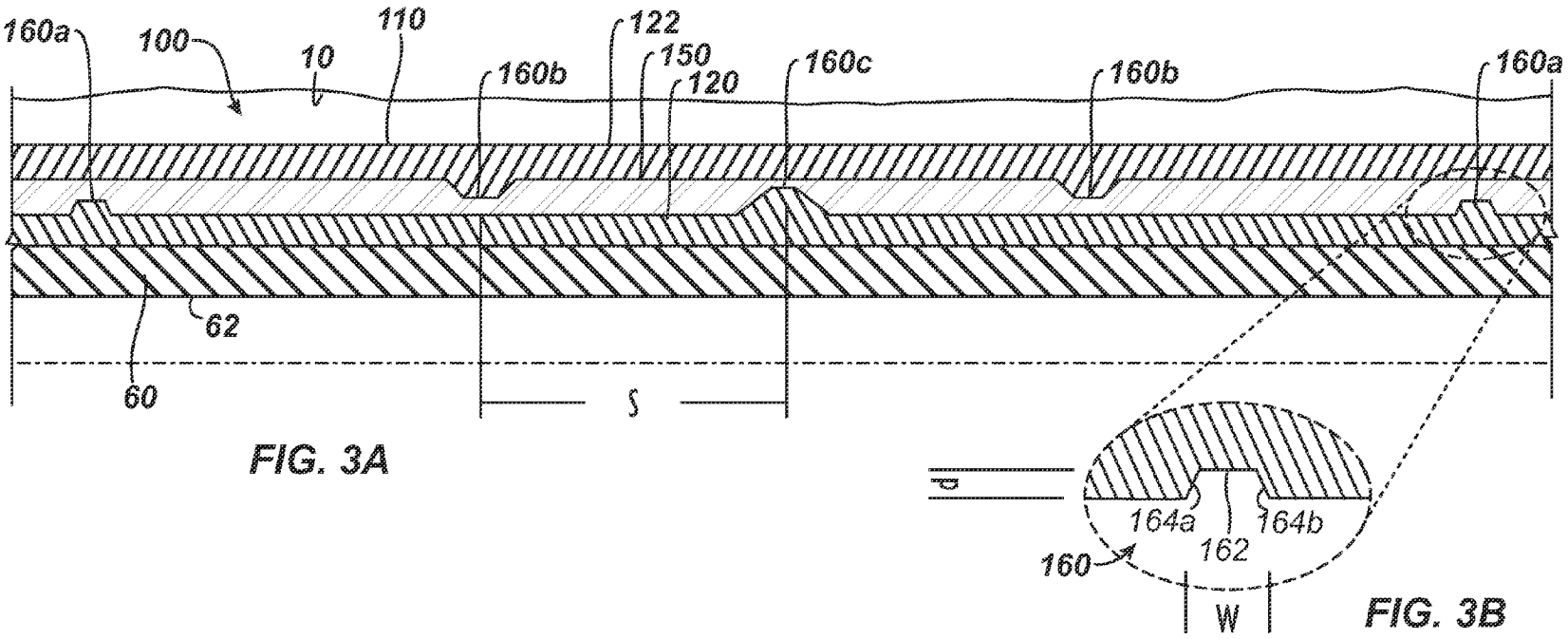
FIG. 3B
FIG. 3A

EXTENDED LENGTH PACKER WITH TIMED SETTING

CROSS-REFERENCE TO RELATED APPLICATIONS

This application claims the benefit of U.S. Provisional Appl. Nos. 61/774,727, filed 8 Mar. 2013, and 61/776,561, filed 11 Mar. 2013, which are incorporated herein by reference.

BACKGROUND

In connection with the completion of oil and gas wells, it is frequently necessary to utilize packers in both open and cased boreholes. The walls of the well or casing are plugged or packed from time to time for a number of reasons. As shown in FIG. 1, for example, sections of a well 10 may be packed off with packers 16 on a tubing string 12 in the well. The packers 16 isolate sections of the well 10 so pressure can be applied to a particular section of the well 10, such as when fracturing a hydrocarbon bearing formation, through a sliding sleeve 14 while protecting the remainder of the well 10 from the applied pressure.

In some situations, operators may prefer to utilize a comparatively long sealing element on the packer's 16. In these instances, as the sealing element is compressed longitudinally by a piston, friction and other forces combine to cause the sealing element to bunch up or otherwise bind near the piston. As a result, the longer sealing element does not uniformly compress in the longitudinal direction and by extension does not expand uniformly in the radial direction. The lack of uniform expansion tends to prevent the packer 16 from forming a seal that meets the operator's expectations, thereby defeating the purpose of utilizing a longer sealing element Therefore, a significant need exists for a packer that is able to utilize an extended length sealing element.

SUMMARY

A packer, plug, or other downhole tool has an extended-length, compressible sealing element. The sealing element is reinforced with a rigid member that causes the sealing element to deform in a controlled manner when the sealing element is longitudinally compressed. The rigid member reinforces certain portions of the sealing element. Yet, the rigid member has one or more areas of decreased rigidity that decreases the reinforcement for certain portions of the sealing element.

By controlling the deformation of the sealing element with the rigid member, unwanted deformation is prevented. Such unwanted deformation is usually caused by friction between the sealing element, the tool's mandrel, and the casing or wellbore. In the past, the unwanted deformation has typically caused longer sealing elements to bunch up on the end of the element closest to the mechanism causing the sealing element to be longitudinally compressed. Additionally, such unwanted deformation has also tended to limit the effectiveness of the seal created between the tool's mandrel and the casing or wellbore by the sealing element. Thus, previous sealing elements on tools, such as packers, have been limited in length in order to retain an effective seal.

In an embodiment of the present disclosure, a rigid member is bonded to the elastomeric sealing element. The rigid member can be a cylinder or can be a plurality of slats. The rigid sealing member has thinner and thicker portions that control the deformation of both the rigid member and the adjacent sealing element with respect to the rest of the sealing element during longitudinal compression of the sealing element. As the rigid member and the elastomer deform, the longitudinal compression causes a first portion of the sealing element to bend outward while the adjacent portion may bend inwards. The first portion bending outwards may tend to seal more against the wellbore wall or the casing while the adjacent portion may tend to seal more against the mandrel. The reverse may also be true depending on the circumstances.

The rigid member can be metallic, non-metallic, or a combination of metallic and non-metallic. In some embodiments, the rigid member can be configured to bend at certain locations, or if desired the rigid member can be configured to break at certain points. In other embodiments, the rigid member can have an accordion-like, corrugated, or spring structure. In this case, this type of rigid member can bend over its length in a single direction, such as longitudinally, while resisting radial deformation.

In another embodiment, an accordion-like, corrugated, or spring-like rigid member may be used to control the expansion of the elastomeric sealing element. By utilizing a structure, such as a spring, the deformation of the sealing element may be locally limited until the entire sealing element has at least partially deformed. The circumferential hoops in the structure, such as a spring, would tend to limit the initial radial expansion of the bonded elastomeric sealing element while allowing the sealing element to be longitudinally compressed.

In another embodiment, a sealing element for use in a wellbore may have an inner elastomeric element, an outer elastomeric element, and a rigid member disposed between them. The rigid member has at least one area of decreased rigidity, such as from a notch of reduced thickness, from a difference in corrugated structure, from a difference in spring strength, and from other differences of the rigid member as disclosed herein.

Although the rigid member may be located between the inner elastomeric element and the outer elastomeric element, the inner elastomeric element and the outer elastomeric element may actually be attached, bonded, molded, or formed to one another. The rigid member may be affixed to the inner elastomeric element and the outer elastomeric element by an adhesive or by bonding, such as during an extrusion process. In some instances, the rigid member may be at least two rigid members, and typically the two rigid members may run parallel to one another along the longitudinal length of the sealing element.

In another embodiment, a sealing element for use in a wellbore may have an elastomeric element and a rigid member having at least one area of decreased rigidity. The rigid member may be attached to the elastomeric element by an adhesive or by bonding such as during an extrusion or molding process. Typically, the rigid member is embedded in the elastomeric element. In some instances, the rigid member may have at least two rigid members, and the rigid members may be linked by a band, such as a circumferential band.

In another embodiment, a sealing element for use in a wellbore may have an elastomeric element and at least one spring. The spring may be embedded in the element or may be attached to the elastomeric element by an adhesive or by bonding, such as during an extrusion or molding process. Typically, the spring limits the initial radial expansion of the elastomeric element when the spring and the elastomeric element are longitudinally compressed. The spring can vary in strength or rigidity along its length. In some instances, more than one spring, such as a first spring and a second spring, may be used end-to-end in a single sealing element. In some instances, the first spring has a first spring strength and the second spring has a second spring strength.

In another embodiment, an apparatus, such as a plug or a packer for use in a wellbore, may have a sealing element having a first elastomeric portion and a second elastomeric portion. The first portion has a first compressive strength and the second portion has a second compressive strength. In some instances the first elastomeric portion and the second elastomeric portions may be connected. In other instances the first elastomeric portion and the second elastomeric portions may be separate.

To seal a downhole tool in a wellbore, the downhole tool is deployed in the wellbore. The compressible element is then sealed in the wellbore by radially expanding the compressible element in response longitudinal compression of the compressible element. This deforms the rigid member. Ultimately, sealing of at least a portion of the compressible element is controlled with the rigid member by deforming at least one area of reduced rigidity on the rigid member adjacent the portion the compressible element different from other portions of the compressible element.

As used herein, the terms such as lower, downhole, downward, upper, uphole, and upward are merely provided for understanding. Additionally, the terms packer and plug may be used interchangeably.

BRIEF DESCRIPTION OF THE DRAWINGS

FIG. 2 depicts a downhole tool in partial cross-section having an extended-length sealing element according to the present disclosure.

FIG. 3A depicts a side view of the disclosed sealing element in an uncased wellbore with an embedded rigid member.

FIG. 3B depicts a detailed cutaway of the disclosed sealing element in FIG. 3A.

DETAILED DESCRIPTION

Figure 1:
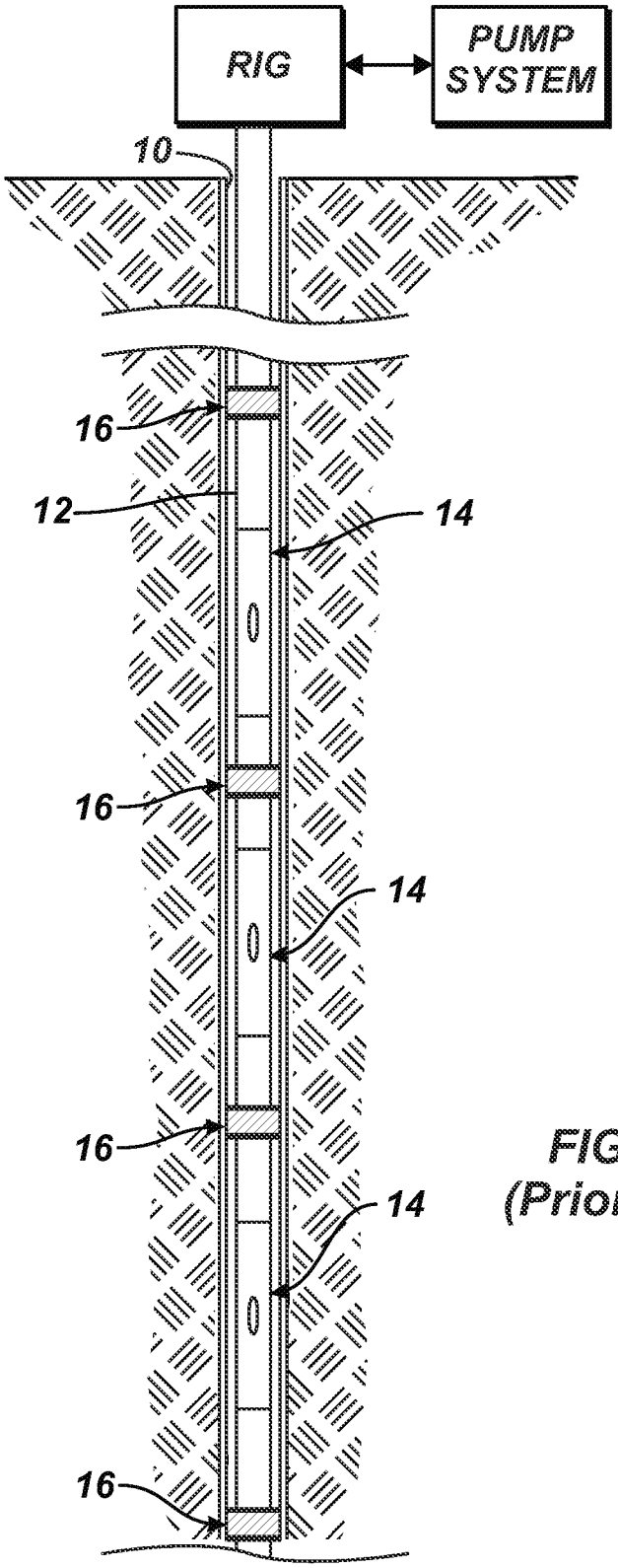
FIG. 1 (Prior Art)
FIG. 1 depicts a wellbore having a tubular with a plurality of sealing element tools disposed thereon.

The description that follows includes exemplary apparatus, methods, techniques, and instruction sequences that embody techniques of the inventive subject matter. However, it is understood that the described embodiments may be practiced without these specific details.

FIG. 2 depicts a downhole tool 50 having a compressible sealing element 100 according to the present disclosure. As depicted herein, the tool 50 can be a packer having a mandrel 60 with a through-bore 62. A fixed end ring 66 is disposed on the mandrel 60 at one end of the sealing element 100. On the opposite end of the sealing element 100, the packer 50 has a setting mechanism 68. Although not shown, the packer 50 can include a slip assembly to lock the packer longitudinally in place in the well and can include other common features. Although shown used on the packer 50, the disclosed sealing element 100 can be used on any type of downhole tool used for sealing in a borehole, including, but not limited to, a packer, a liner hanger, a bridge plug, a fracture plug, and the like.

The sealing element 100 has an initial diameter to allow the packer 50 to be run into a well and has a second, radially-larger size when compressed to seal against the wellbore. When the packer 50 is set downhole, the mandrel 60 is held in place and force is applied longitudinally to the sealing element 100 by the setting mechanism 68, which in this example is a hydraulic piston mechanism.

For example, the mechanism 68 is activated by a build-up of hydraulic pressure in a chamber of the mechanism 68 through a port 64 in the mandrel 60. In turn, the piston mechanism 68 pushes against the end of the sealing element 100 to compress the sealing element 100 longitudinally. As it is compressed, the sealing element 100 expands radially outward to engage the surrounding surface, which can be an open or cased hole. Although the tool 50 is shown as being hydraulically actuated, other types of mechanisms 68 known in the art can be used on the tool 50 including, mechanical, hydro-mechanical, and electrical mechanisms for compressing the sealing element 100.

As briefly depicted in FIG. 2, the sealing element 100 has an elastomeric member 110 disposed adjacent the mandrel 60 of the tool 50. The sealing element 100 also has a rigid member 150 disposed in or associated with the elastomeric member 110. The rigid member 150 has at least one area of decreased rigidity or reduced thickness. The rigid member 150 can be metallic, non-metallic, or a combination of metallic and non-metallic. For example, the rigid member 150 can be composed of metal, plastic, elastomer, or the like. In some embodiments, the rigid member 150 can be configured to bend at certain locations, or if desired the rigid member 150 can be configured to break at certain points.

The element's elastomeric member 110 can be attached, bonded, molded, or formed on the mandrel 60 and the rigid member 150 in any suitable fashion. For instance, the element's elastomeric member 110 can be comprised of separate layers 120 and 122 of the same or different elastomeric material. The rigid member 150 may be affixed between the inner elastomeric layer 120 and the outer elastomeric layer 122 by an adhesive or by bonding, such as during an extrusion or molding process. Alternatively, the rigid member 150 may be molded or embedded directly into the elastomeric material of the member 110.

In any event, the member 110 has an outer elastomeric portion or layer 120 disposed external to an inner elastomeric layer 122. Each of the layers 120 and 122 may be separate elements or sleeves disposed, molded, or formed on the rigid member 150. Alternatively, the inner and outer elastomeric layers 120 and 122 may be integrally molded or formed portions of the same underlying element on the rigid member 150.

In one embodiment, the rigid member 150 is a cylindrical sleeve disposed about the mandrel 60. In another embodiment, the rigid member 150 is comprised of several longitudinal strips disposed parallel to one another along the axis of the sealing element 100 and the mandrel 60. In yet another embodiment, the rigid member 150 is a cage structure having a combination of cylindrical bands disposed around the mandrel 60 and having a number of longitudinal members spaced around the mandrel 60.

FIG. 3A depicts an embodiment of a compressible sealing element 100 in more detail relative to an uncased wellbore 10 and a mandrel 60. While the uncased wellbore 10 is depicted, any of the embodiments can be used in open holes or in casing. Again, as noted above, the sealing element 100 circumferentially surrounds the mandrel 60 and includes the elastomeric member 110 and the rigid member 150. The elastomeric member 110 has its radially inward layer 120, which can be of a first elastomer, and has its radially outward layer 122, which can be of a second elastomer. The first and second elastomers may be of the same elastomer, or they may be different elastomers depending upon the sealing characteristics desired.

The rigid member 150 is disposed as an intermediate layer in the elastomeric member 110. The rigid member 150 may be affixed to one or both of the push rings (not shown), or the ends of the members 150 may simply abut adjacent the rings. As shown, the rigid member 150 has areas of different rigidity or thicknesses along its length. In the embodiment depicted, thinned regions or notches 160*a-c* are alternatingly facing opposing sides of the rigid member 150. For instance, first notches 160*a*, 106*c* face inward toward the mandrel 60, while second notches 160*b* face outward towards the wellbore 10. The layers 120 and 122 can fill in the various notches 160*a-c* with material, depending on how the layers 120 and 122 are formed on the rigid member 150 and mandrel 60.

As shown in the detail of FIG. 3B, each notch 160 may have a bottom wall 162 and angled sidewalls 164*a-b*, although curved or other rectilinear profiles can be used. In any event, each notch 160 defines a particular depth (d) and width (w) in the rigid member 150. Additionally, the various notches 160*a-c* are defined at various spacings (s) from one another along the length of the rigid member 150.

In general, the depths (d), widths (w), and spacings (s) of the notches 160*a-c* can be the same or different, but the characteristics of the notches 160*a-c* can be configured to govern how the rigid member 150 will bend and the sealing element 100 will deform when compressed. In particular, the depths (d), widths (w), and spacings (s) of the notches 160*a-c* determine what direction and when the rigid member 150 will deform at particular locations.

Moving the notch sidewalls 164*a-b* in towards one another as well as increasing the angle of the notch sidewalls 164*a-b* can determine how far the rigid member 150 will initially deform. The depth (d) of each notch 160*a-b* can determine the order in which the various notches 160*a-c* will deflect. For instance, shallower notches 160*a* leave a thicker bridge of material on the rigid member 150. Such a thicker bridge will allow this portion of the rigid member 150 around the shallower notch 160*a* to deform later than a deeper notch 160*c* having a thinner bridge of material. Additionally, the location of a given notch 160*a-c* in either side of the rigid member 150 determines in which direction the rigid member 150 will deform. A notch 160*b* that faces the wellbore 10 tends to cause the rigid member 150 to deform away from the wellbore 10, while a notch 160*a*, 160*c* facing the mandrel 60 tends to cause the rigid member 150 to deform away from the mandrel 60.

The notches 160 may be reversed. Furthermore, thinner notches 160 can be positioned in the middle, on the outer portion, or to one side of the rigid member 150 depending of the desired outcome of the element's compression. Additionally, deeper notches 160 can be positioned on the top end of the rigid member 150 and shallower on the bottom end, or vice versa.

Because the sealing element 100 has an extended length, the timing of how it deforms as it is longitudinally compressed on the mandrel 60 can be controlled by the rigid member 150 so the element 100 does not prematurely buckle, crease, fold, or otherwise expand improperly against the surrounding wall. In this particular example having five notches 160*a-c* along the length of the element 100, the notches 160*a-c* are symmetrically arranged with a center notch 160*c*, two intermediate notches 160*b*, and two end notches 160*a*. The depth (d), width (w), angles, etc. of the center notch 160*c* are configured to force the center portion of the element 100 to deform and set first. This is not strictly necessary because there may be implementations in which the center portion sets after one or both of the ends.

In this implementation, however, the intermediate notches 160*b* spaced outside of the center notch 160*c* are configured with widths (w) and depths (d) to set later at a delayed timing from the center notch 160*c*. By first setting the center of the element 100 followed and then setting outward along the length of the element 100, fluid can escape from the annulus between the element 100 and the wellbore 10 during setting procedures. Finally, the end notches 160*a* spaced toward the ends of the element 100 are configured to set even later during the overall setting process.

The arrangement here is symmetrical and includes five notches 160*a-c*. Other configurations can be used with more or less notches 160, and such an alternating arrangement can be repeated along the length of the sealing element 100. Accordingly, the number of notches 160 may vary depending on the length of the element 100 and the desired number of timed seal points.

Figure 4:
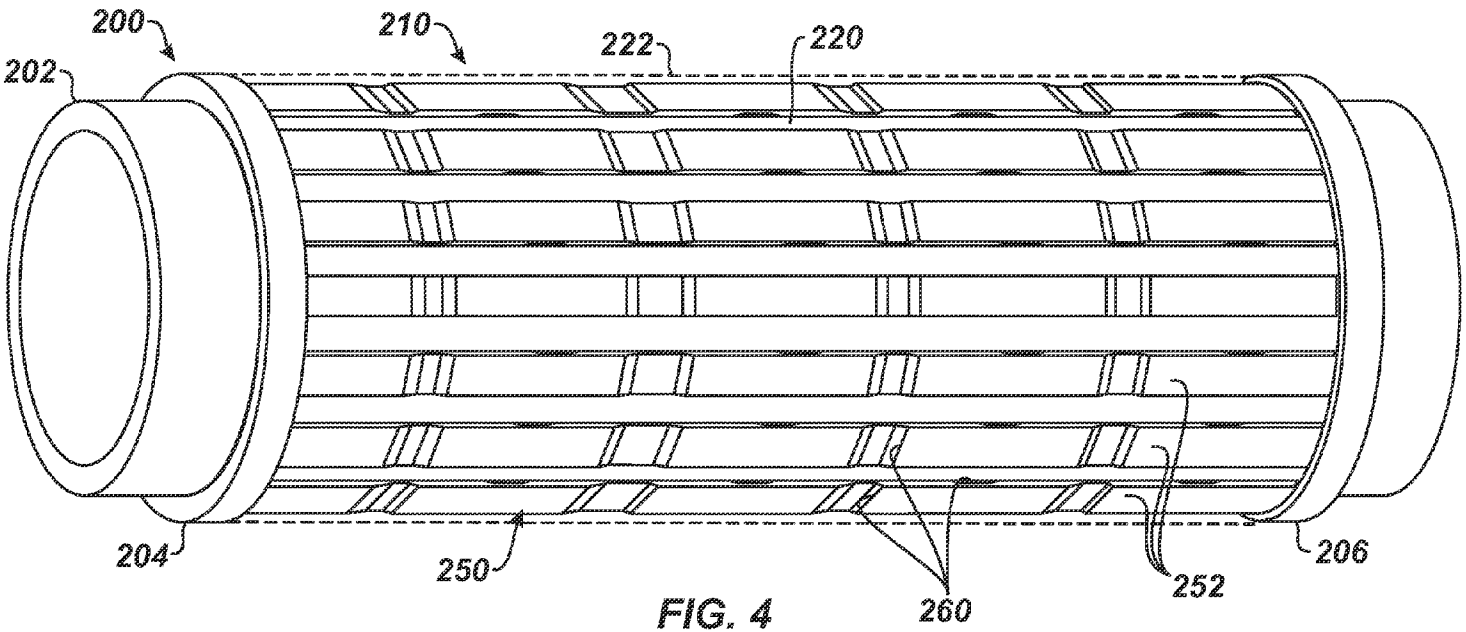
FIG. 4 depicts a perspective view of a sealing element with an embedded rigid member.

FIG. 4 depicts a side view of a sealing element 200 mounted on a mandrel 202 with a first push ring 204 and a second push ring 206. As will be appreciated, the mandrel 202 and push rings 204 and 206 can be components of a downhole tool, such as a packer or a plug. The sealing element 200 has an elastomeric member 210 with a plurality of spaced apart rigid members 250 embedded therein. The rigid members 250 run parallel to one another along the length of the elastomeric member 210. As noted above, the elastomeric member 210 has a radially inward elastomeric layer 220 and a radially outward elastomeric layer 222, which is shown in dashed line to reveal details of the rigid members 250.

Each rigid member 250 has notches 260. As noted previously, each notch 260 may have a width, depth, notch bridge thickness, distance between the notch sidewalls, and notch sidewall angles that are configured different or similar to one another depending upon the desired deformation characteristics. Additionally, the notches 260 can be arranged to face inward and/or outward as desired. Each notch 260 tends to cause the rigid members 250 to deflect radially inward or outward in an organized way configured for a particular implementation, as disclosed herein.

Here, the rigid members 250 are a plurality of longitudinal strips or slats disposed parallel to one another along the longitudinal axis and around the circumference of the elastomeric element 210. The members 250 may be affixed to one or both of the push rings 204 and 206, or the ends of the members 250 may simply abut adjacent the rings 204 and 206. Again, the rigid members 250 can be composed of any suitable material, including metal, plastic, or an elastomer more rigid than the overall sealing element 200.

Figure 5:
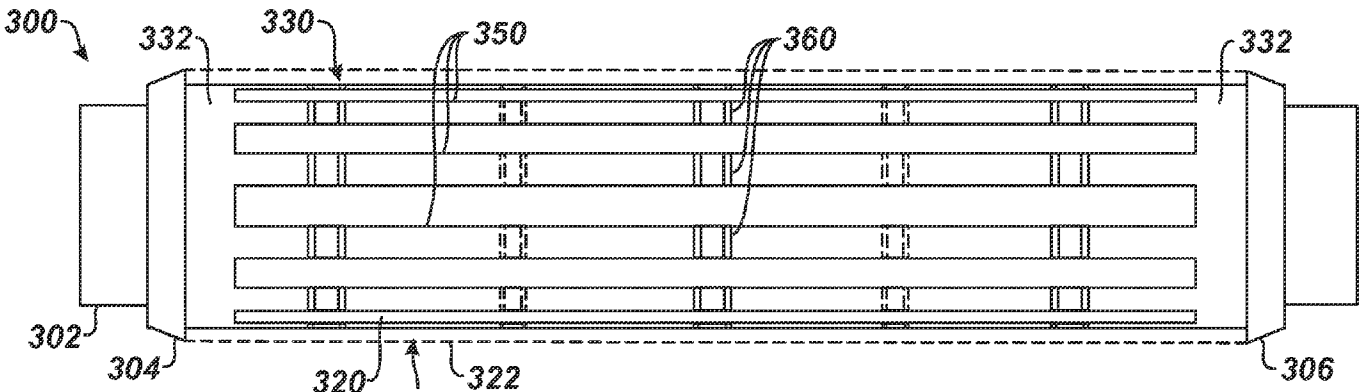
FIG. 5 depicts a side view of a sealing element with an embedded rigid member having circumferential bands.

FIG. 5 depicts a side view of a compressible sealing element 300 mounted on a mandrel 302 with a first push ring 304 and a second push ring 306. As will be appreciated, the mandrel 302 and push rings 304 and 306 can be components of a downhole tool, such as a packer or a plug. The sealing element 300 has an elastomeric member 310 with a rigid member in the form of a cage 330 embedded therein. As noted above, the elastomeric member 310 has a radially inward elastomeric layer 320 and a radially outward elastomeric layer 322, which is shown in dashed line to reveal details of the rigid cage 330.

For its part, the rigid cage 330 has rings or bands 332 with a plurality of rigid strips or slats 350 running parallel to one another along the length of the cage 330. The rings 332 and the rigid slats 350 are attached to one another and are embedded in the radially inward and outward elastomeric layers 320 and 322 (depicted in dashed lines). The bands 332 can be affixed to or abut against the push rings 304 and 306. Although the bands 332 are shown at the ends of the cage 330 one or more bands can also be used at intermediate locations of the cage 330 between the ends.

Each rigid slat 350 has notches 360. As before, each notch 360 may have a different notch bridge thickness, a different distance between the notch sidewalls, different notch sidewall angles, face inward or outward, and other features depending upon the desired deformation characteristics.

Figure 6:
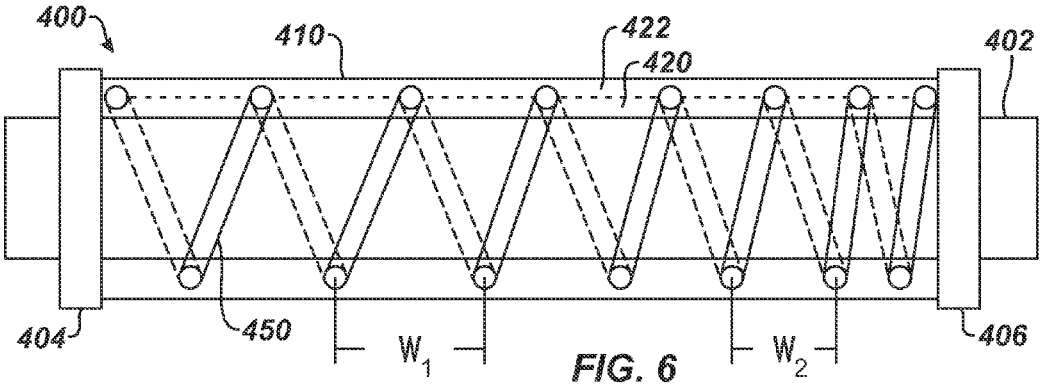
FIG. 6 depicts a side view of a sealing element with an embedded spring.

FIG. 6 depicts a side view of a compressible sealing element 400 mounted on a mandrel 402 with a first push ring 404 and a second push ring 406. As will be appreciated, the mandrel 402 and push rings 404 and 406 can be components of a downhole tool, such as a packer or a plug. The sealing element 400 has an accordion-like structure, which in this case is a spring 450. The spring 450 is embedded in the elastomeric member 410. For example, the spring 450 can be attached to a radially inward elastomeric layer 420 and to a radially outward elastomeric layer 422.

The spring 450 varies in rigidity by varying in pitch from the push rings 404 and 406 as it progresses longitudinally along the elastomeric sealing element 410. In some instances, the spring 450 can vary in pitch from the first push ring 404 towards the second push ring 406 in any combination that meets the operator's requirements. The spring's 450 variation in pitch can be seen as a different in the distance between the spring's hoops, such as the different distances ($w_1$) and ($w_2$) depicted in FIG. 6.

The circumferential hoops formed by the spring 450 as it circumferentially surrounds the mandrel 402 can tend to limit the initial radial expansion of the sealing element 400 while allowing the sealing element 400 to be longitudinally compressed. The differences in distances between the hoops tend to allow the sealing element 400 to radially expand at certain location to an extent greater than where the spring's 450 hoops are closer together. In certain instances, it may be desirable to utilize an accordion-like structure that does not vary in pitch but tends to limit the initial radial expansion of the elastomeric sealing element 400 to a uniform amount.

Figure 7:
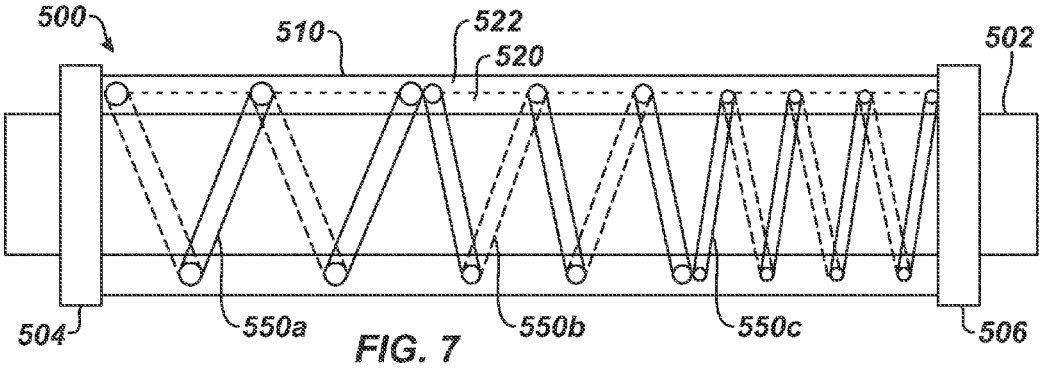
FIG. 7 depicts a side view of a sealing element with multiple embedded springs.

FIG. 7 depicts a side view of a compressible sealing element 500 mounted on a mandrel 502 with a first push ring 504 and a second push ring 506, which can be components of a downhole tool, such as a packer or a plug. The sealing element 510 has at least two accordion-like structures 550*a-c*, in this case a first spring 550*a*, a second spring 550*b*, and a third spring 550*c*.

The springs 550*a-c* are embedded in the elastomeric member 510. For example, the springs 550*a-c* can be attached to a radially inward elastomeric layer 520 and to a radially outward elastomeric layer 522. In FIG. 7, the radially outward elastomeric layer 522 is shown in dashed line overlaying the springs 550*a-c* and attached to the inward elastomeric layer 520.

Each spring 550*a-c* varies in strength or the force exerted as the spring 550*a-c* compresses. In FIG. 7, the strength of each spring 550*a-c* decreases as the springs 550*a-c* are longitudinally positioned along the mandrel 502 from one push ring 504 to the other. Other configurations could be used. For example, opposing sets of springs could decrease in strength from the two push rings 504 and 506 towards the center of the element 500. In fact, any combination of varying strength of each spring 550 could be used to meet the operator's requirements.

When the sealing element 500 is set, the weakest spring (e.g., 550*c*) will tend to longitudinally compress first, thereby causing the sealing element 510 adjacent to the spring 550*c* to longitudinally compress and thereby radially expand. By varying the strength of each spring 550*a-c*, the timing of the radial expansion of each portion of the sealing element 500 may be controlled by the operator.

Figure 8:
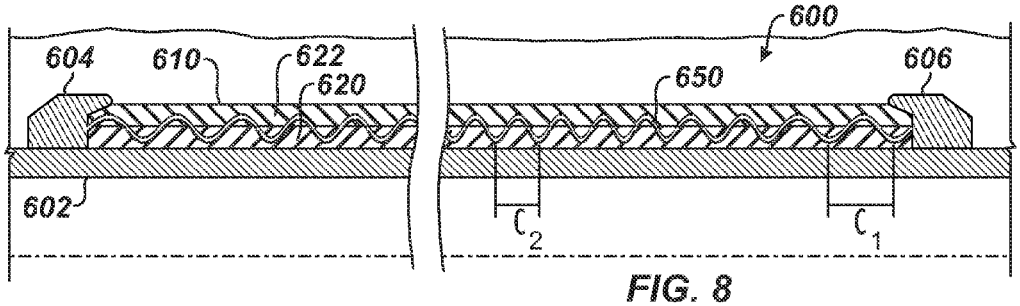
FIG. 8 depicts a side view of another sealing element having a corrugated rigid member.

FIG. 8 depicts a side view of a compressible sealing element 600 having a corrugated rigid member 650. The sealing element 600 is mounted on a mandrel 602 between first and second push rings 604 and 606, which can be components of a downhole tool, such as a packer or a plug. The sealing element 600 consists of inward and outward elastomeric sealing elements 610 and 620 with the corrugated or crumpled rigid member 650 disposed therebetween. Spacing between corrugations can vary along the length of the mandrel 602, thereby altering the flexibility and stiffness of the various sections of the member 650. In FIG. 8, for example, the corrugations near the push rings 604 and 606 have widths (e.g., $c_1$) that is greater than the widths (e.g., $c_2$) of the corrugations near the center of the element 600. Thus, the flexibility of the rigid member 650 increases longitudinally from the push rings 604 and 606 toward the center of the element 600. Other configurations could be used. For example, the flexibility can increase along the length of the element 600 from one push ring 604 to the other 606. In fact, any combination of flexibility could be used to meet the operator's requirements.

When the packer and thus the sealing element 600 is set, the more flexible sections of the rigid member 650 tend to longitudinally compress first, thereby causing the elastomeric sealing element 600 to radially expand. By varying the flexibility, the timing of the radial expansion of the sealing element 600 may be controlled by the operator.

Figure 9:
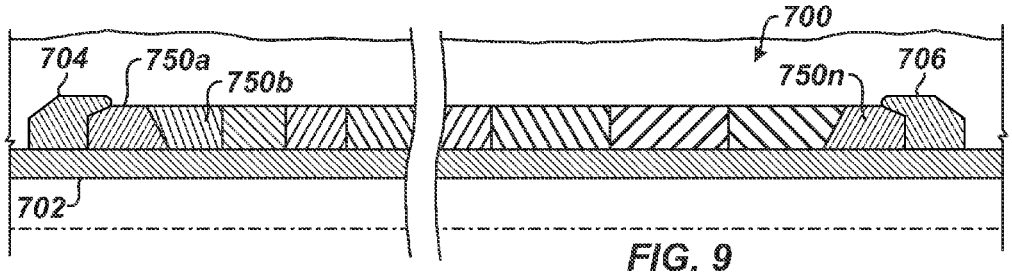
FIG. 9 depicts a side view of a sealing element having portions of varying compressive strength along its longitudinal length.

Finally, FIG. 9 depicts a side view of a compressible sealing element 700 mounted on a mandrel 702 with a first push ring 704 and a second push ring 706, which can be components of a downhole tool, such as a packer or a plug. The sealing element 700 consists of longitudinally separate elastomeric sealing members or sections 750*a-n* disposed along the mandrel 702 between the push rings 704 and 706. As shown here, each of the sections 750*a-n* can be a separate washer, ring, wrapping, or sleeve portion disposed on the mandrel 702.

Each section 750*a-n* of the sealing element 700 varies in compressive strength or the force required to compress each section 750*a-n*. In a variation of this embodiment, the longitudinally separate sections 750*a-n* of elastomer could be a single elastomeric member, in which the elastomeric compounds differ over the element's length, thereby providing variations in the compressive strength of the sealing element 700 over its length.

In FIG. 9, the strength of each elastomeric sealing sections 750*a-n* increases as the section 750*a-n* are longitudinally positioned along the mandrel 702 from one of the push ring 704. Other configurations could be used. For example, opposing sets of sections 750 could decrease in strength from the two push rings 704 and 706 towards the center of the element 700. In fact, any combination of varying strength of each section 750 could be used to meet the operator's requirements.

When the packer and thus the sealing element 700 is set, the weakest elastomeric sealing section (e.g., 750*n*) tends to longitudinally compress first, thereby causing the elastomeric sealing element 700 to radially expand. By varying the compressive strength of each elastomeric sealing section 750*a-n*, the timing of the radial expansion of each portion of the sealing element 700 may be controlled by the operator.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for sealing in a wellbore, the apparatus comprising:

a compressible element disposed on the apparatus and defining a first longitudinal axis, the compressible element expanding radially to seal in the wellbore in response compression of the compressible element along the first longitudinal axis; and a rigid member disposed in the compressible element; the rigid member defining a second longitudinal axis disposed along the first longitudinal axis of the compressible element and having inner and outer surfaces, the inner and outer surfaces being flat along the second longitudinal axis except for a plurality of notches of decreased rigidity indented in at least one of the inner and outer surfaces along the second longitudinal axis, each of the notches being adjacent to an adjacent portion of the compressible element and deforming in response to compression along the second longitudinal axis, timings of the radial expansion of the adjacent portions of the compressible element for at least the first and second ones of the notches being different from one another and wherein the plurality of notches do not longitudinally overlap with each other.

2. The apparatus of claim 1, wherein each of the notches of decreased rigidity indented in the at least one of the inner and outer surfaces comprise a reduced thickness defined in the rigid member.

3. The apparatus of claim 1, wherein the rigid member is embedded in the compressible element.

4. The apparatus of claim 1, wherein the compressible element comprises an inner portion of elastomeric material disposed on the apparatus and comprises an outer portion of elastomeric material disposed external to the inner portion, the rigid member disposed between the inner and outer portions.

5. The apparatus of claim 1, wherein the rigid member comprises at least two rigid slats disposed parallel to one another along the first longitudinal axis of the compressible element.

6. The apparatus of claim 5, wherein the rigid member comprises a plurality of the rigid slats disposed around the compressible element and forming a cylinder disposed along the first longitudinal axis of the compressible element.

7. The apparatus of claim 1, wherein each of the notches comprises a characteristic of the decreased rigidity, the characteristics of the notches being different from one another along a length of the rigid member.

8. The apparatus of claim 1, wherein the notches comprise a first set of the notches defined on the inside surface of the rigid member and comprises a second set of the notches defined on the outside surface of the rigid member.

9. The apparatus of claim 7, wherein the characteristic of the decreased rigidity comprises at least one of a depth and a width of the notches.

10. The apparatus of claim 1, wherein the notches of decreased rigidity of the rigid member control the radial expansion of the compressible element from the apparatus when compressed thereon.

11. The apparatus of claim 1, wherein the rigid member comprises a cage having at least two rigid slats.

12. The apparatus of claim 11, wherein the cage comprises at least one band linking the at least two rigid slats together.

13. The apparatus of claim 1, further comprising:

a mandrel of the apparatus on which the compressible element is disposed; and at least one push member disposed on the mandrel adjacent the compressible element and being movable on the mandrel to compress the compressible element.

14. The apparatus of claim 1, wherein the apparatus is selected from the group consisting of a packer, a liner hanger, a plug, a bridge plug, and a fracture plug.

15. The apparatus of claim 1, wherein at least third and fourth of the notches share the timing of the radial expansion to seal the adjacent portions the compressible element, one of the third and fourth notches being the same as or different from one of the first and second notches.

16. A method of sealing a downhole tool in a wellbore, the method comprising:

deploying the downhole tool in the wellbore, the downhole tool having a compressible element with a first longitudinal axis, the compressible element having a rigid member disposed therein, the rigid member defining a second longitudinal axis disposed along the first longitudinal axis and having inner and outer surfaces, the inner and outer surfaces being flat along the second longitudinal axis except for a plurality of notches of decreased rigidity indented in at least one of the inner and outer surfaces along the second longitudinal axis, each of the notches being adjacent to an adjacent portion of the compressible element; sealing the compressible element in the wellbore by radially expanding the compressible element in response to longitudinal compression of the compressible element along the first longitudinal axis;

and controlling sealing of the adjacent portions of the compressible element with the rigid member by deforming the notches of reduced rigidity on the rigid member to radially expand the adjacent portions of the compressible element, timings of the radial expansion of the adjacent portions for at least the first and second ones of the notches being different from one another and wherein the plurality of notches do not longitudinally overlap with each other.

17. The method of claim 16, wherein deforming each of the notches of reduced rigidity on the rigid member comprises sharing the timings of the radial expansion of the adjacent portions for at least third and fourth of the notches, one of the third and fourth notches being the same as or different from one of the first and second notches.

* * * * *